US008388322B2

(12) United States Patent
Scharfenberg

(10) Patent No.: US 8,388,322 B2
(45) Date of Patent: Mar. 5, 2013

(54) ELECTRONIC FUEL PUMP

(75) Inventor: Robert E. Scharfenberg, St. Louis, MO (US)

(73) Assignee: Fluid Control Products, Inc., Litchfield, IL (US)

( * ) Notice: Subject to any disclaimer, the term of this patent is extended or adjusted under 35 U.S.C. 154(b) by 1071 days.

(21) Appl. No.: 12/221,736

(22) Filed: Aug. 6, 2008

(65) Prior Publication Data

US 2009/0107470 A1 Apr. 30, 2009

Related U.S. Application Data

(60) Provisional application No. 61/001,001, filed on Oct. 30, 2007.

(51) Int. Cl.
*F01C 1/356* (2006.01)

(52) U.S. Cl. ..... 417/410.3; 417/410.1; 418/104; 418/148

(58) Field of Classification Search ..... 123/497; 417/410.1, 410.3; 418/104, 148, 149, 158, 418/225

See application file for complete search history.

(56) References Cited

U.S. PATENT DOCUMENTS

| | | | | |
|---|---|---|---|---|
| 3,168,102 | A | 2/1965 | Tyler et al. | |
| 3,919,981 | A | 11/1975 | Reddy | |
| 4,004,556 | A * | 1/1977 | Pfeiffer | 123/213 |
| 4,240,382 | A | 12/1980 | Reddy | |
| 4,278,061 | A | 7/1981 | Werner et al. | |
| 4,494,509 | A | 1/1985 | Long | |
| 4,656,827 | A | 4/1987 | Puillet | |
| 4,692,105 | A * | 9/1987 | Leroy | 418/184 |
| 4,711,216 | A | 12/1987 | Takeuchi et al. | |
| 4,926,829 | A | 5/1990 | Tuckey | |
| 4,951,636 | A | 8/1990 | Tuckey et al. | |
| 5,044,890 | A | 9/1991 | Loeffler et al. | |
| 5,064,362 | A * | 11/1991 | Hansen | 418/186 |
| 5,120,201 | A | 6/1992 | Tuckey et al. | |
| 5,791,888 | A * | 8/1998 | Smith | 418/149 |
| 5,848,583 | A | 12/1998 | Smith et al. | |
| 5,881,698 | A | 3/1999 | Tuckey et al. | |
| 6,008,603 | A * | 12/1999 | Jones et al. | 318/400.32 |
| 6,298,731 | B1 | 10/2001 | Wade et al. | |
| 6,302,144 | B1 | 10/2001 | Graham et al. | |
| 6,414,455 | B1 * | 7/2002 | Watson | 318/432 |
| 6,622,707 | B2 | 9/2003 | Begley et al. | |
| 6,889,656 | B1 | 5/2005 | Rembold et al. | |
| 7,043,960 | B1 | 5/2006 | Lueck | |
| 7,185,634 | B2 | 3/2007 | Gardner et al. | |
| 7,188,610 | B2 | 3/2007 | Crary et al. | |
| 7,207,319 | B2 | 4/2007 | Utsumi | |
| 7,234,293 | B2 | 6/2007 | Yates et al. | |
| 7,632,084 | B2 * | 12/2009 | Sawai et al. | 418/236 |
| 2002/0020397 | A1 | 2/2002 | Begley et al. | |
| 2003/0044300 | A1 * | 3/2003 | Osugi et al. | 418/260 |
| 2004/0124807 | A1 * | 7/2004 | Nakata et al. | 318/801 |

(Continued)

OTHER PUBLICATIONS

Jianwen Shao, Dennis Nolan, Maxime Teissier, David Swanson, "A Novel Microcontroller-Based Sensorless Brushless DC (BLDC) Motor Drive for Automotive Fuel Pumps", Nov./Dec. 2003, IEEE Transaction on Industry Applications, vol. 39, No. 6.

*Primary Examiner* — Charles Freay
*Assistant Examiner* — Christopher Bobish
(74) *Attorney, Agent, or Firm* — Don V. Kelly; Evans & Dixon, LLC

(57) ABSTRACT

A fuel pump for deployment in a fuel system for an internal combustion engine comprises a 3-phase brushless direct current motor, a sling vane impeller with blade-shaped sling vanes, sensorless electronic motor drive and an electronic controller. The controller is adapted to receive analog or pulse-width modulation inputs to control pump speed.

16 Claims, 5 Drawing Sheets

U.S. PATENT DOCUMENTS

2004/0172188 A1 9/2004 Bowling et al.
2005/0084391 A1* 4/2005 Grant ..... 417/313
2005/0284448 A1 12/2005 Forgue et al.
2006/0185631 A1 8/2006 Fitzgerald
2006/0236981 A1 10/2006 Bickley
2007/0122300 A1* 5/2007 Sakai et al. ..... 417/423.3

* cited by examiner

ELECTRONIC FUEL PUMP

CROSS REFERENCE TO RELATED APPLICATION

This application claims the benefit of U.S. Provisional Application No. 61/001,001, filed on Oct. 30, 2007. The entire content of that application is incorporated by reference.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to pumps for moving fluid through a system and, more particularly, to a fuel pump for use in a fuel system for an internal combustion engine.

BACKGROUND OF THE INVENTION

A prior art fuel system for an engine-driven vehicle having electronic fuel injection (EFI) includes a fuel tank, a fuel pump and a fuel line that delivers fuel from the pump to fuel injectors disposed in a fuel rail. The fuel pump of the prior art EFI fuel system comprises an electrically driven motor using brushes for motor commutation. High flow rate fuel pumps require high amounts of electrical power. When used in typical fuel systems (where the pump operates at constant full power) brushed pumps can create excessive heat. This build up of heat in the fuel system can lead to cavitation failures and low efficiency engine demand. High current draw during idle and low cruise put extra strain on the vehicle charging system as well. To address these problems, speed controllers are available to reduce the speed of the pump during low engine demand operating conditions. These controllers typically comprise electronic control modules connected to sensors disposed in the fuel system. The controllers also are electrically connected to the fuel pump and operate to alter pump speed by outputting a pulse width modulated power supply signal. This process reduces the incoming voltage to the fuel pump by limiting current draw. The use of such pump control systems has limited efficiency due to the reliance on fuel pumps employing motor brushes. In addition, such electronic control devices can be expensive and hence are not universally employed.

It is also known in the prior art to use a fuel pump comprising a brushless motor. Such motors use a rotor cylindrically arranged within a stator assembly. Such brushless motors include hall effect switches for motor commutation and mechanically transmit power to an impeller having "roller" or "pin" shaped vanes. The impeller and motor of this pump are axially aligned in the direction of fuel flow. The prior art brushless motor however has certain drawbacks including over-compression or over-expansion of fuel while coursing through the pump and a limited ability to control the pump.

SUMMARY OF THE INVENTION

This invention seeks to solve the foregoing problems associated with the fuel pump of the prior art. The invention is directed to a fuel pump comprising a housing having a cylindrical casing, a first end cap and a second end cap. The first end cap has a fuel inlet port and the second end cap has a fuel outlet port. The pump further comprises a brushless electric motor having a permanent magnet armature and sensorless electronic drive. The brushless motor is disposed within the casing such that the permanent magnet rotor rotates within the housing and about a longitudinal axis of the casing. The brushless motor is axially coupled to pump means within the casing. The pump means is disposed between the fuel inlet port and the fuel outlet port and comprises an impeller having sling vanes disposed within a pressuring chamber. The pressuring chamber is defined by a molded inner projection of the housing having an inlet surface and outlet surface. Inlet passages are disposed on the inlet surface to allow the flow of fuel into the pressuring chamber. The action of the impeller's rotating and sliding sling vanes within the pressuring chamber displaces a volume of fuel out through outlet passages in the outlet surface and toward the fuel outlet port. The pump further includes a controller comprising electronic circuitry mounted within the housing and adapted to preferably receive analog inputs from one or more external electric sources and output a power supply signal to the brushless electric motor based upon those inputs.

In a preferred embodiment the brushless motor is 3-phase brushless motor. By using a brushless motor, efficiency is greatly enhanced over the entire operating range of motor. The motor configuration is cylindrical whereby the magnet rotor is co-axially housed about a stator wire assembly. A shaft attached to the magnet rotor passes coaxially through the stator wire assembly and couples to pump means.

The fuel pump of the present invention further comprises a sensorless drive for motor commutation. Sensorless drive uses a voltage reading from the "neutral phase" to measure proper positioning of the magnet rotor. By using this method, the pump does not require the additional hall effect switching mechanisms that other pumps require.

The preferred embodiment pump of the present invention utilizes a rotary positive displacement pump mechanism. In the preferred embodiment, the pump includes an impeller having sling vanes with blade shaped vanes. In contrast, the pump of the prior art typically uses roller or pin shaped vanes. The vanes are made of carbon to reduce weight and increase reliability of the component. In addition, the pump housing is specially shaped to reduce compression or expansion of fluid while trapped volumes of fluid are between flow paths. Though the disclosed embodiment utilizes an impeller with sling vanes as a pump mechanism, other pump formats such as gerotor (rotary gear), rotary lobe, progressing cavity, piston, diaphragm, screw, gear, regenerative and peristaltic may be used.

The pump further comprises a dual inlet-dual outlet design, where the passages (ports) leading into and out of the impelling chamber are symmetric about the impeller axis to allow the pressures developed by the pump to be canceled out, reducing impeller bearing stress.

The pump further includes electronic circuitry that can preferably receive an analog signal input to control the speed of the fuel pump. This enables the pump to be controlled via other devices. This feature can allow additional control without the need for a pulse width modulation device as required by prior art pumps with DC brushed motors. Hence, the pump does not require an additional device to control its speed and users of the pump have a wide range of options for controlling speed. External electronic devices that can be used to control the output of the fuel pump include a simple potentiometer, an electronic control module (ECM), which could be an engine control computer, or other electronic device. Alternatively, the external electronic devices can be made to provide for constant voltage supply to the pump.

By the combination of the above-described features, the problems of the prior art fuel pump are ameliorated or solved. By combining the external speed control with a brushless motor, overall current draw of the fuel pump is reduced and additional efficiency is realized. Reducing current also favorably reduces the amount of fuel system heating, plus reduces alternator drag on vehicle engine.

DETAILED DESCRIPTION OF THE PREFERRED EMBODIMENT

Figure 1:
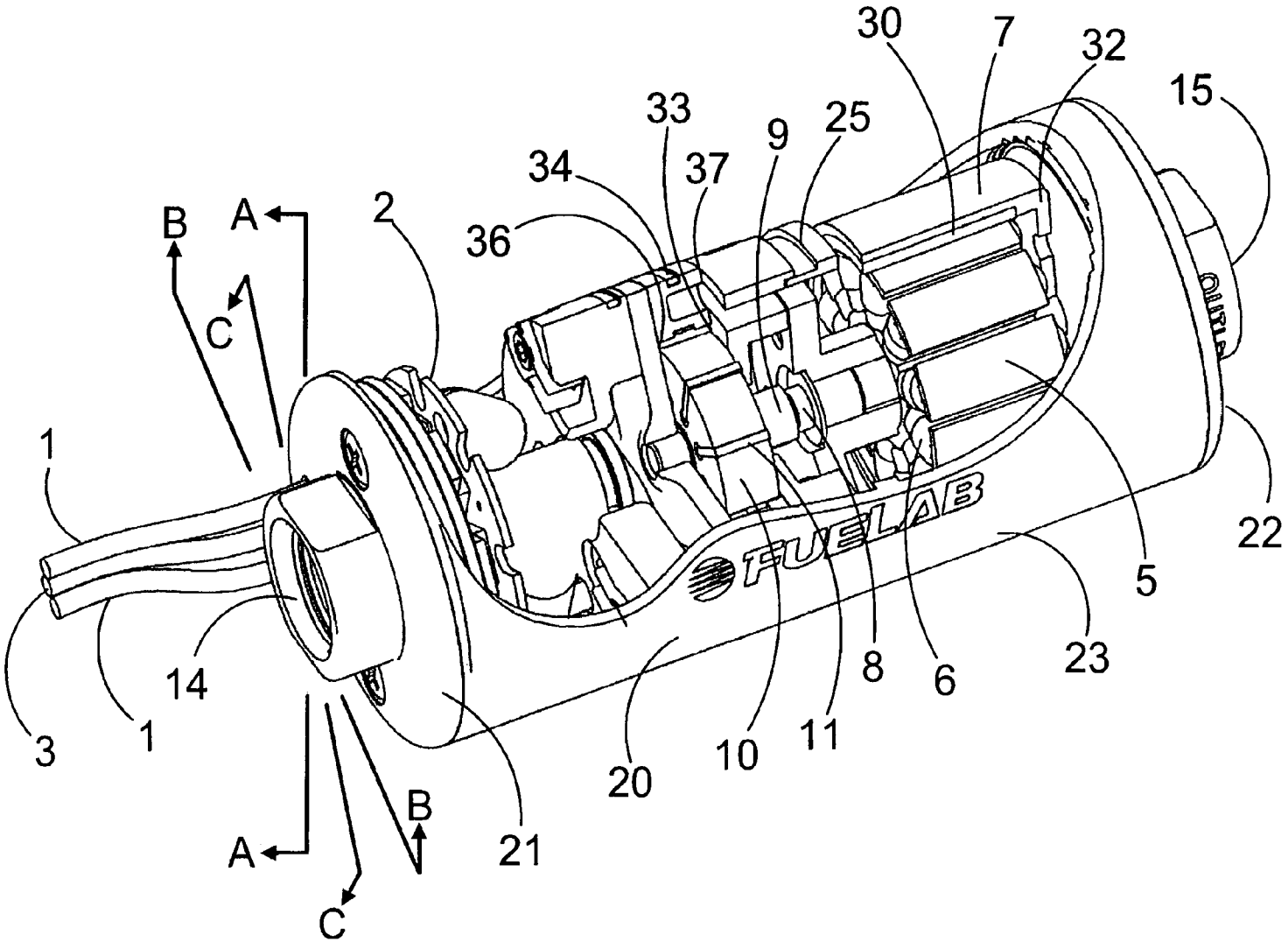
FIG. 1 is a perspective cut-away view of the fuel pump of the present invention.
Figure 2:
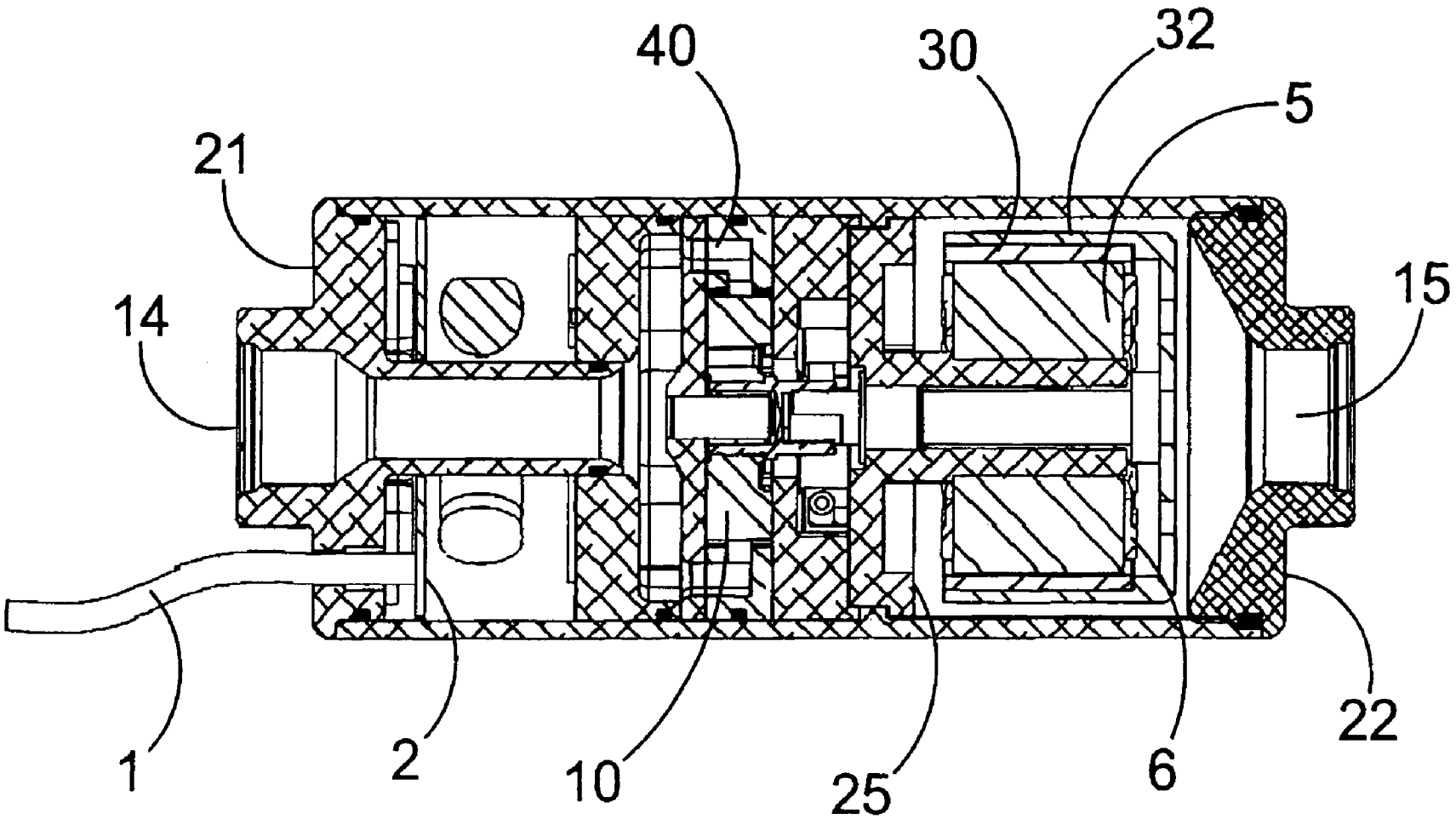
FIG. 2 is a cross-sectional view of a preferred embodiment of the present invention fuel pump taken along line B-B of FIG. 1.
Figure 3:
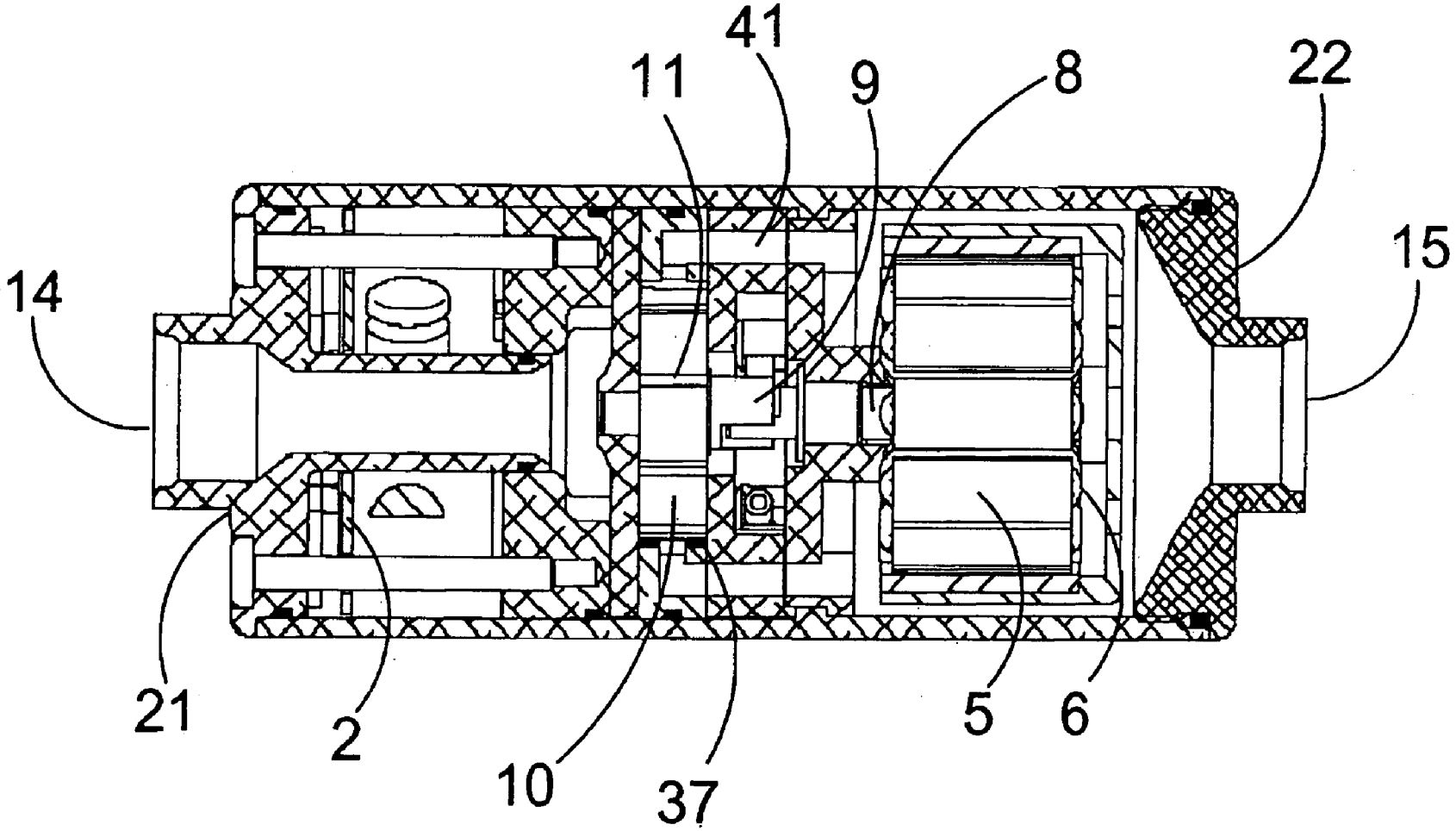
FIG. 3 is a cross-sectional view of a preferred embodiment of the present invention fuel pump taken along line A-A of FIG. 1.
Figure 4:
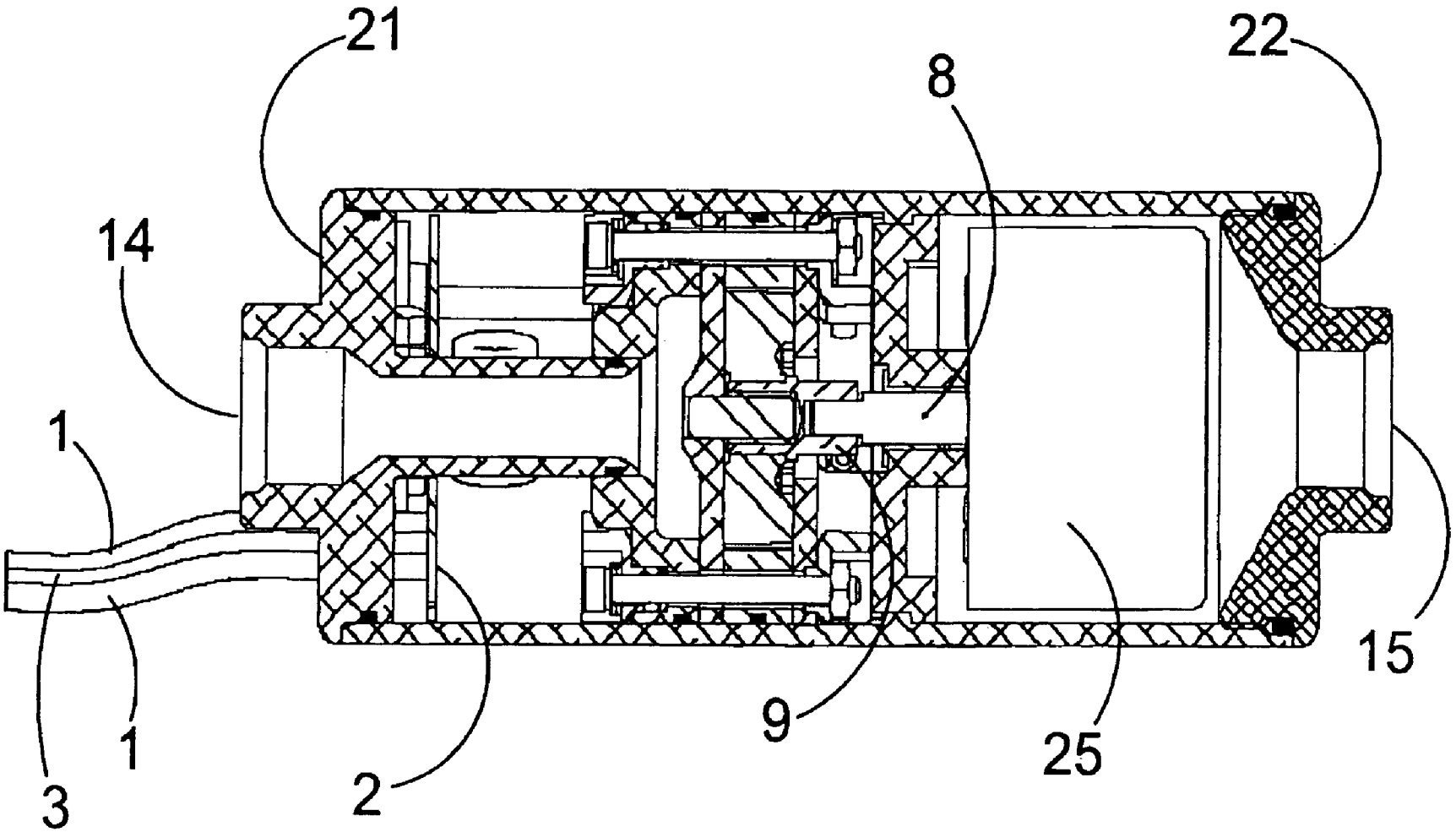
FIG. 4 is a cross-sectional view of a preferred embodiment of the present invention fuel pump taken along line C-C of FIG. 1.

The structure and operation of the present invention fuel pump is explained in reference to FIGS. 1-5. FIG. 1 depicts a cut-away perspective view of a preferred embodiment fuel pump 100 of the present invention. As seen in FIG. 1 pump 100 includes outer housing 20 comprising casing 23 with end caps 21 and 22. In a preferred embodiment casing 23 may be cylindrical. Fuel inlet port 14 and outlet port 15 are disposed respectively in end caps 21 and 22. Wire leads 1 supply electric power through end cap 21 and into motor electronic controller board 2. A speed control harness 3 consisting of three wires also passes through outer end cap 21 and into electric connection with controller 2. Pump 100 further includes a motor assembly 25 including a fixed stator assembly 5 containing magnet wire coils 6. Stator assembly 5 is disposed within outer rotor assembly 7. Rotor assembly (armature) 7 contains permanent magnets 30 disposed about a motor axis in longitudinal arrangement with the length of casing 23. The return flux of magnets 30 through outer steel shell 32 causes the rotation of motor shaft 8 when coils 6 are electrified. Motor shaft 8 is coupled to pump means disposed within housing 20.

Motor assembly 25 does not employ hall effect switches for motor commutation. Instead, motor assembly 25 uses a "sensorless drive" to achieve commutation. Sensorless drive uses a voltage reading from the "neutral phase" to measure proper positioning of the dc motor rotor. This commutation method does not require the extra switching mechanism of the conventional prior art motor.

In the disclosed preferred embodiment the disclosed pump means includes impeller 10 disposed within pressuring chamber 33. In the depicted embodiment shaft 8 is connected to hub 9 of impeller 10 and thereby transmits rotational force to impeller 10. Pressuring chamber 33 is defined by the inner surface 35 of molded inner projection 34 of casing 23. Impeller 10 includes vanes 11 constrained between slots disposed on the radial surface of impeller 10. Molded inner projection 34 includes inlet surface 36 with passages 40. Outlet surface 37 includes passages 41. Surface 37 and passages 41 are in broken lines in FIG. 5. Upon electrification of motor 25, magnets 30 rotate about the described motor axis and cause motor impeller 10 to rotate as well. The rotational movement of impeller 10 draws fluid through passages 40 and into pressuring chamber 33. As fluid passes through pressuring chamber 33 volume changes are produced between the sling vanes 11 of impeller 10. The volume changes between the vanes 11 draw fuel through the passages 40 in inlet surface 36 and expel the fuel through passages 41 of outlet surface 37 toward outlet port 15.

Figure 5:
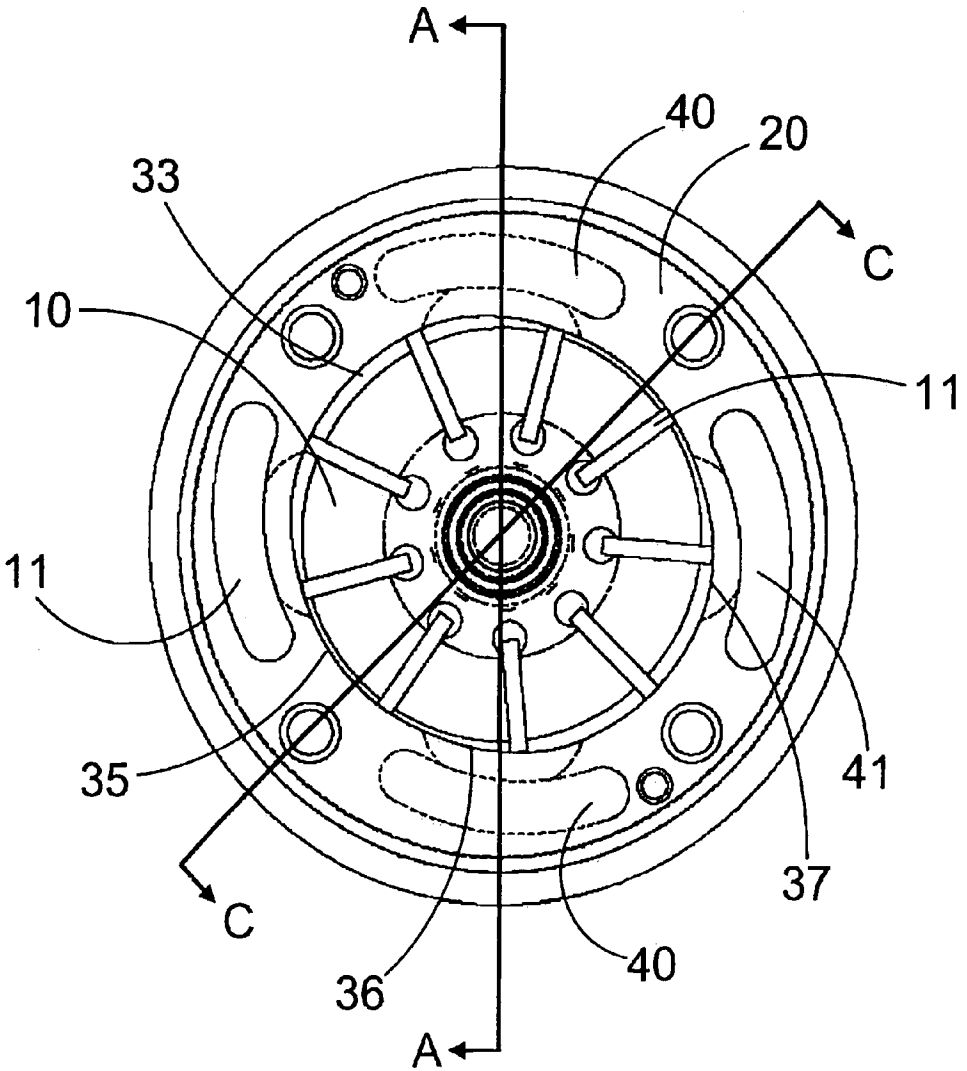
FIG. 5 is an axial elevation view of the impelling chamber employing the impeller with positive sling vane displacement of the present invention fuel pump.

Impeller 10 is preferably made from a plastic composite instead of steel, to reduce weight and increase reliability. As shown in FIG. 5, the shape of pressuring chamber 33 is sinusoidally derived. In experiments, this shape housing has been shown to reduce compression or expansion of fluid while trapped volumes of fluid are between flow paths. In addition, pressuring chamber 33 preferably includes a "dual inlet-dual outlet" design, whereby passages 40, 41 are arranged symmetrically about the rotor axis (such that the inlet passages are in opposing positions and the outlet passages are in opposing positions) to allow the pressures developed by the pump to be canceled out, thus reducing bearing stress.

The structure and operation of the controller circuitry will now be explained. The three wires of harness 3 include an analog input signal (0-5 Volt) lead for speed control, a signal ground lead and constant 5 Volt output lead. A variable signal from an electronic device can be attached to the analog input signal lead and signal ground lead of harness 3 to allow for adjustment of pump motor speed. Controller 2 operates initially as a stepper motor to establish rotation of the motor assembly such that a timed response is used without reference to motor rotor position. When the motor is spinning, controller 2 uses a voltage reading from the neutral phase of motor assembly 25 for motor commutation. Controller 2 uses MOSFETS to allow electrical current to pass through motor 25. By including controller 2 in pump 100, pump 100 can use an analog signal input to control the speed of the fuel pump. This enables pump 100 to be electronically controlled by one or more other devices without the need for a pulse width modulation device as required for pumps with DC brushed motors. Suitable control devices can include a simple potentiometer, a stand-alone electronic control module or an engine control computer. A suitable control device may also include a constant 5-volt output. By using an analog input signal to control speed, various forms of pump control can be implemented. Output from an electronic device such as a sensor can change pump speed as a function of pressure, throttle position, engine speed, or fuel injector dwell time. By using an analog input signal to control speed, various forms of pump control can be implemented. Typical aftermarket engine management units have analog outputs that can allow direct control of pump speed.

An alternate method of speed control exists as a single wire signal input (relative to power ground of pump). The signal input consists of a pulse-modulated signal at a given frequency relating dwell time of signal to pump speed. This type of signal is similar to the modulated power signal described herein, except the signal is not used as a source of power, but instead a low current control signal compatible with aftermarket engine management units. This type of signal has an advantage of direct compatibility to typical aftermarket engine management units, and requires only a single wire for signal input. One further advantage is a greater accuracy of signal input that is not susceptible to varying resistance of connectors and wire.

Bench testing of the present invention pump has shown increased efficiency over conventional brush type fuel pumps. Though the fuel pump of the present has particular advantageous application in a fuel system using electronic fuel injection, it can be used with carbureted fuel delivery systems for internal combustion engines. This invention can apply to other hydraulic pumping system. The pump could be used in aerospace applications for both manned and unmanned vehicle systems. Other types of industrial and laboratory applications can also apply, as this system also greatly increases efficiency of constant pressure, variable flow hydraulic pumping systems.

What is claimed is:

1. A pump for deployment in a fuel system, the pump comprising:

a housing having a casing, a first end cap and a second end cap, the first end cap having a fuel inlet port and the second end cap having a fuel outlet port;

a brushless DC electric motor having a permanent magnet armature and sensorless electronic drive, the motor being disposed within the housing such that the permanent magnet armature rotates within the casing and about a longitudinal axis of the casing;

the armature of the brushless motor axially coupled to pump means within the casing, the pump means disposed between the fuel inlet port and the fuel outlet port and comprising an impeller having sling vanes disposed within a pressuring chamber defined by an inner surface on a molded inner projection of the casing;

the molded inner projection of the casing further having an inlet surface and an outlet surface; and the inlet surface having passages to allow the flow of fuel into the pressuring chamber and the outlet surface having passages to allow the flow of fuel out of the pressuring chamber; and a controller comprising electronic circuitry mounted within the housing and adapted to receive analog inputs from one or more external electric devices and output a power supply signal to the brushless electric motor.

2. The pump of claim 1 wherein the casing is cylindrical.

3. The pump of claim 2 wherein the inlet surface passages and outlet surface passages are arranged symmetrically about the longitudinal axis of the casing such that the inlet passages are in opposing positions and the outlet passages are in opposing positions.

4. The pump of claim 1 wherein the external electric devices include a potentiometer, a stand-alone electronic control module, an engine control computer or a constant voltage supply.

5. The pump of claim 1 wherein the vanes are made of carbon.

6. The pump of claim 1 wherein the pressuring chamber is sinusoidally derived.

7. The pump of claim 1 wherein the controller is adapted to receive analog inputs via a three wire harness having a lead for transmitting an analog input signal of 0 to 5 volts, a lead for transmitting a ground signal and a lead for transmitting a constant 5 volt output.

8. The pump of claim 1 wherein the controller is adapted to receive a single wire signal input, wherein the signal input consists of a pulse-modulated signal at a given frequency relating dwell time of signal to pump speed.

9. A pump for pumping fluid, the pump comprising:

a housing having a casing, a first end cap and a second end cap, the first end cap having a fluid inlet port and the second end cap having a fluid outlet port;

a brushless DC electric motor having a permanent magnet armature and sensorless electronic drive, the motor being disposed within the housing such that the permanent magnet armature rotates within the casing and about a longitudinal axis of the casing;

the armature of the brushless motor axially coupled to pump means within the casing, the pump means disposed between the fluid inlet port and the fluid outlet port and comprising an impeller having sling vanes disposed within a pressuring chamber defined by an inner surface on a molded inner projection of the casing;

the molded inner projection of the casing further having an inlet surface and an outlet surface; and the inlet surface having passages to allow the flow of fluid into the pressuring chamber and the outlet surface having passages to allow the flow of fluid out of the pressuring chamber; and a controller comprising electronic circuitry mounted within the housing and adapted to receive analog inputs from one or more external electric devices and output a power supply signal to the brushless electric motor.

10. The pump of claim 9 wherein the casing is cylindrical.

11. The pump of claim 9 wherein the inlet surface passages and outlet surface passages are arranged symmetrically about the longitudinal axis of the casing such that the inlet passages are in opposing positions and the outlet passages are in opposing positions.

12. The pump of claim 9 wherein the external electric devices include a potentiometer, a stand-alone electronic control module, an engine control computer or a constant voltage supply.

13. The pump of claim 9 wherein the vanes are made of carbon.

14. The pump of claim 9 wherein the pressuring chamber is sinusoidally derived.

15. The pump of claim 9 wherein the controller is adapted to receive analog inputs via a three wire harness having a lead for transmitting an analog input signal of 0 to 5 volts, a lead for transmitting a ground signal and a lead for transmitting a constant 5 volt output.

16. The pump of claim 9 wherein the controller is adapted to receive a single wire signal input, wherein the signal input consists of a pulse-modulated signal at a given frequency relating dwell time of signal to pump speed.

* * * * *